US010868376B2

(12) United States Patent
Chalas et al.

(10) Patent No.: US 10,868,376 B2
(45) Date of Patent: Dec. 15, 2020

(54) HEADER CONNECTOR INCLUDING PRESS-FIT SIGNAL CONTACTS

(71) Applicant: TE CONNECTIVITY CORPORATION, Berwyn, PA (US)

(72) Inventors: Guadalupe Chalas, Harrisburg, PA (US); John Wesley Hall, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 28 days.

(21) Appl. No.: 16/114,333

(22) Filed: Aug. 28, 2018

(65) Prior Publication Data

US 2020/0076099 A1 Mar. 5, 2020

(51) Int. Cl.

| | |
|---|---|
| ***H01R 13/648*** | (2006.01) |
| ***H01R 13/73*** | (2006.01) |
| ***H01R 13/10*** | (2006.01) |
| ***H01R 4/66*** | (2006.01) |
| ***H01R 33/00*** | (2006.01) |
| ***H01R 12/58*** | (2011.01) |
| ***H01R 12/70*** | (2011.01) |
| ***H01R 13/17*** | (2006.01) |
| ***H01R 13/502*** | (2006.01) |
| ***H01R 13/52*** | (2006.01) |
| ***H01R 13/6471*** | (2011.01) |
| ***H01R 13/6585*** | (2011.01) |
| *H01R 13/627* | (2006.01) |

(52) U.S. Cl.

CPC ..... *H01R 12/585* (2013.01); *H01R 12/7005* (2013.01); *H01R 13/17* (2013.01); *H01R 13/502* (2013.01); *H01R 13/521* (2013.01); *H01R 13/6471* (2013.01); *H01R 13/6585* (2013.01); *H01R 13/6275* (2013.01); *H01R 2201/26* (2013.01)

(58) Field of Classification Search

CPC ..... H01R 4/00; H01R 9/00; H01R 11/00
USPC ..... 439/607.35, 559, 682
See application file for complete search history.

(56) References Cited

U.S. PATENT DOCUMENTS 4,907,990 A * 3/1990 Bertho ..... H01R 13/11 439/682
5,174,764 A * 12/1992 Kandybowski ..... H01R 12/716 439/83
5,509,823 A * 4/1996 Harting ..... H01R 12/57 439/607.17

(Continued)

OTHER PUBLICATIONS

International Search Report, International Application No. PCTIB2019/056780, International Filing Date, Aug. 8, 2019.

*Primary Examiner* — Abdullah A Riyami
*Assistant Examiner* — Thang H Nguyen

(57) ABSTRACT

A header connector includes a header housing having a mating end and a mounting end mounted to a circuit board. The header housing has a cavity at the mating end and a flange forming a seal pocket with a seal. A signal contact is received in a signal contact channel of the header housing having a mounting end having a compliant pin configured to be press-fit into a plated via of the circuit board. A ground shield is received in a ground shield channel of the header housing providing electrical shielding for the signal contact. The ground shield has a compliant pin configured to be press-fit into a plated via of the circuit board.

27 Claims, 6 Drawing Sheets

(56) References Cited

U.S. PATENT DOCUMENTS

| | | | | |
|---|---|---|---|---|
| 6,817,887 | B2 * | 11/2004 | Jones | H01R 13/6275 439/405 |
| 7,892,025 | B2 * | 2/2011 | Daily | H01R 13/504 439/606 |
| 7,980,881 | B2 * | 7/2011 | Furio | H01R 13/6592 439/364 |
| 8,328,572 | B2 * | 12/2012 | Tashiro | H01R 13/5208 439/271 |
| 8,430,691 | B2 * | 4/2013 | Davis | H01R 13/6585 439/607.09 |
| 9,099,814 | B2 * | 8/2015 | Snader | H01R 13/6599 |
| 9,590,348 | B2 * | 3/2017 | Grudzewski | H01R 13/5202 |
| 9,742,081 | B1 * | 8/2017 | Annis | H01R 12/7082 |
| 9,806,443 | B1 * | 10/2017 | Thackston | H01R 12/7082 |
| 10,096,930 | B2 * | 10/2018 | Kondo | H01R 13/512 |
| 10,396,486 | B2 * | 8/2019 | de Chazal | H01R 13/4368 |
| 10,439,333 | B2 * | 10/2019 | Chalas | H01R 12/716 |
| 2007/0184701 | A1 * | 8/2007 | Yagome | H01R 13/506 439/271 |
| 2011/0045693 | A1 * | 2/2011 | Uchida | H01R 13/746 439/567 |
| 2011/0300757 | A1 * | 12/2011 | Regnier | H01R 43/20 439/626 |
| 2012/0208400 | A1 * | 8/2012 | De Chazal | H01R 13/6581 439/607.58 |
| 2014/0004740 | A1 * | 1/2014 | Uno | H01R 13/6596 439/607.58 |
| 2014/0057493 | A1 * | 2/2014 | De Geest | H01R 12/737 439/607.35 |
| 2017/0302012 | A1 * | 10/2017 | Shibaya | H01R 13/512 |

* cited by examiner

HEADER CONNECTOR INCLUDING PRESS-FIT SIGNAL CONTACTS

BACKGROUND OF THE INVENTION

The subject matter herein relates generally to a header connector.

Header connectors are used in communication systems to mate with mating connectors, such as plug connectors. In some applications, the header connector is mounted to a printed circuit board for electrically connecting the mating connector to the printed circuit board. In automotive applications, electrical connectors are subject to harsh environments due to heat, debris, moisture and vibration. Conventional header connectors are soldered to the printed circuit board to withstand the harsh environment, such as the vibration. However, soldering the signal and ground contacts to the printed circuit board adds an additional step to the assembly process, adding assembly time and cost.

A need remains for a robust and cost effective automotive header connector.

BRIEF DESCRIPTION OF THE INVENTION

In one embodiment, a header connector is provided including a header housing having a mating end configured to be mated with a mating connector and a mounting end configured to be mounted to a circuit board. The header housing has a cavity at the mating end and a flange forming a seal pocket. The header housing has a signal contact channel open to the cavity and a ground shield channel open to the cavity. A seal is received in the seal pocket that is exposed at the mating end for interfacing with the mating connector. A signal contact is received in the signal contact channel. The signal contact has a mating end configured to be mated with the mating connector and a mounting end having a compliant pin configured to be press-fit into a plated via of the circuit board. A ground shield is received in the ground shield channel. The ground shield extends along the mating end of the signal contact and provides electrical shielding for the signal contact. The ground shield has a compliant pin configured to be press-fit into a plated via of the circuit board.

In another embodiment, a header connector is provided including a header housing having a mating end configured to be mated with a mating connector and a mounting end configured to be mounted to a circuit board. The header housing has a base at the mounting end and a tower extending from the base to the mating end having a cavity. The header housing has a flange extending from at least one of the tower and the base. The flange has a lip forming a seal pocket. The header housing has signal contact channels through the base open to the cavity and a ground shield channel through the base open to the cavity. A seal is received in the seal pocket being exposed at the mating end for interfacing with the mating connector. Signal contacts are received in corresponding signal contact channels and arranged as a pair configured to convey differential signals. Each signal contact has a mating end configured to be mated with the mating connector and a mounting end having a compliant pin configured to be press-fit into a plated via of the circuit board. A ground shield is received in the ground shield channel having a shroud extending along the mating ends of the signal contacts and providing electrical shielding for the signal contacts. The shroud is configured to be mated with the mating connector. The ground shield has a compliant pin configured to be press-fit into a plated via of the circuit board.

DETAILED DESCRIPTION OF THE INVENTION

Figure 1:
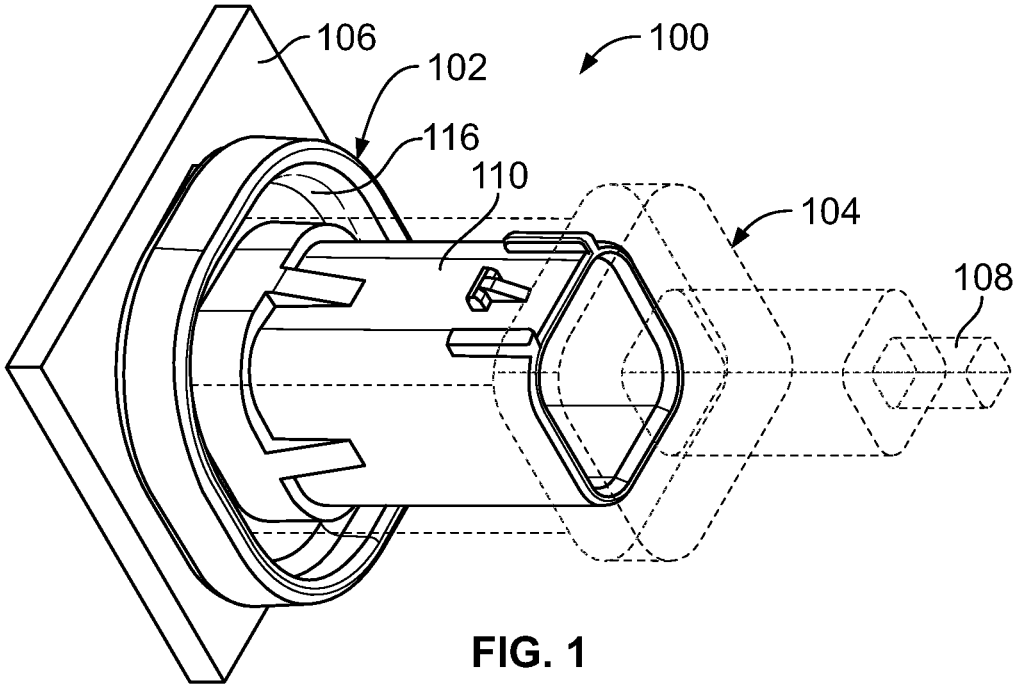
FIG. 1 illustrates a communication system in accordance with an exemplary embodiment.

FIG. 1 illustrates a communication system 100 in accordance with an exemplary embodiment. The communication system 100 includes a first electrical connector 102 mated with a second electrical connector 104 (shown in phantom to illustrate the first electrical connector 102). The first electrical connector 102 is mounted to a circuit board 106. In the illustrated embodiment, the second electrical connector 104 provided at an end of a cable 108 extending to another electrical component. However, the second electrical connector 104 may be mounted to a circuit board in alternative embodiments. The first electrical connector 102 and the second electrical connector 104 electrically connect the circuit board to the electrical component. In an exemplary embodiment, the first electrical connector 102 is a header connector and may be referred to hereinafter as a header connector 102. In an exemplary embodiment, the second electrical connector 104 is a plug connector or mating connector and may be referred to hereinafter as a plug connector 104 or a mating connector 104.

Figure 2:
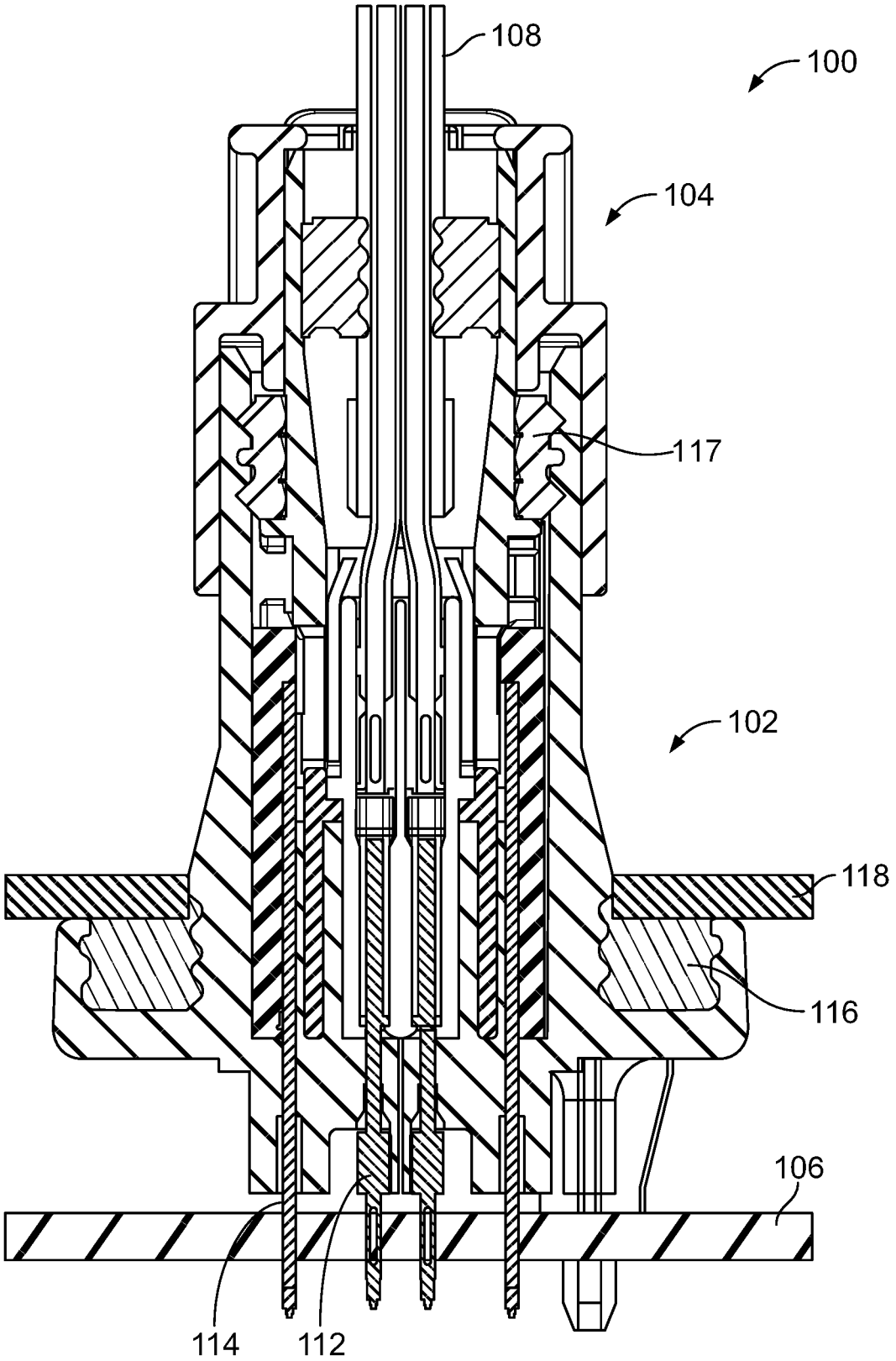
FIG. 2 is a cross sectional view of the communication system in accordance with an exemplary embodiment.

The header connector 102 includes a header housing 110 holding one or more signal contacts 112 (shown in FIG. 2) and holding one or more ground shields 114 (shown in FIG. 2). The ground shield 114 provide electrical shielding for the signal contacts 112. The ground shield 114 is configured to be electrically connected to a corresponding ground contact of the mating connector 104 to electrically common the ground shield 114 with the mating connector 104. The ground shield 114 forms a shielded connection with the mating connector 104, such as for high speed data signaling through the header connector 102. The ground shield 114 is configured to be electrically commoned to one or more ground circuits or ground planes of the circuit board 106.

In an exemplary embodiment, the header connector 102 includes a seal 116 coupled to the header housing 110. The seal 116 is configured to seal against a panel 118 (shown in FIG. 2) to provide a sealed mating interface between the header connector 102 and the panel 118. In various embodiments, the seal 116 is a rubber gasket defining an interface seal configured to engage the panel 118. The seal 116 provides environmental sealing for the header connector 102, such as for sealing debris, moisture or other contaminants from the signal contacts 112. In various embodiments, the header connector 102 and/or the mating connector 104 may include seals (not shown) to define a sealed connection between the header connector 102 and the mating connector 104.

FIG. 2 is a cross sectional view of the communication system 100 showing the mating connector 104 mated to the header connector 102. The header connector 102 is electrically connected to the circuit board 106. The header connector 102 is mounted to a panel 118 and extends through an opening in the panel 118. The seal 116 is sealed to a rear side of the panel 118 and the circuit board 106 is located behind the panel 118. The mating end of the header connector 102 extends through the panel 118 to the front side of the panel 118 for mating with the mating connector 104 exterior of or forward of the panel 118. In the illustrated embodiment, the mating connector 104 includes a seal 117 being sealed to an interior of the header housing 110. The signal contacts 112 are used to electrically connect signal lines of the mating connector 104 to the circuit board 106. The ground shield 114 is used to electrically connect a ground component of the mating connector 104 to the circuit board 106. For example, the ground shield 114 may be electrically connected to a ground shield of the mating connector 104, which may be electrically connected to a cable shield of the cable 108.

Figure 3:
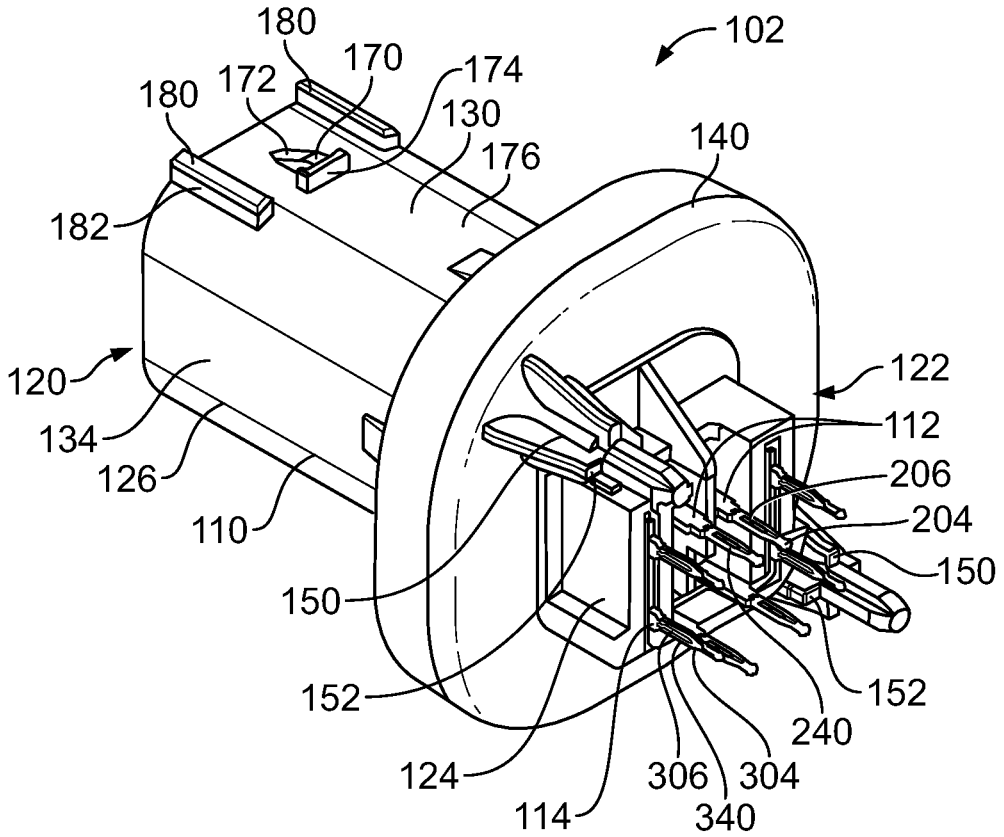
FIG. 3 is a rear perspective view of a header connector of the communication system in accordance with an exemplary embodiment.
Figure 4:
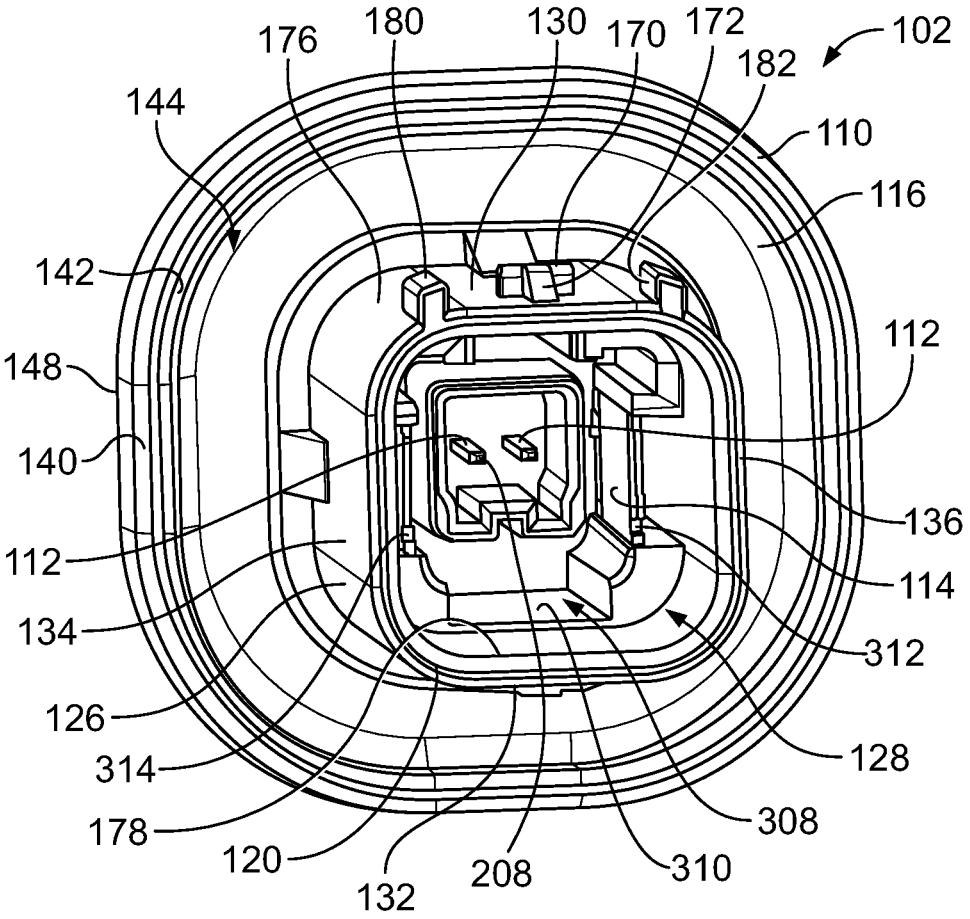
FIG. 4 is a front perspective view of the header connector in accordance with an exemplary embodiment.
Figure 5:
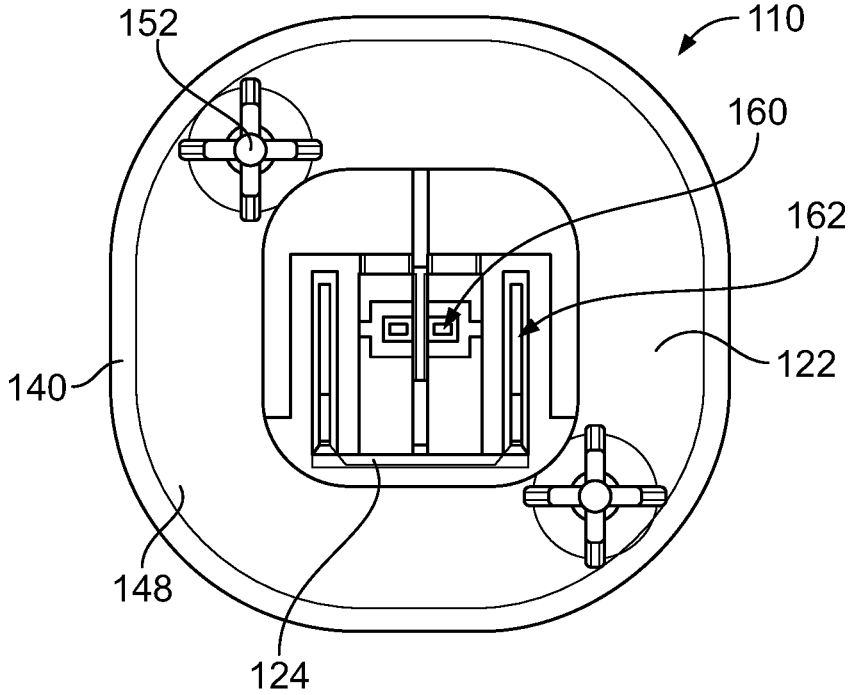
FIG. 5 is a rear view of a header housing of the header connector in accordance with an exemplary embodiment.

FIG. 3 is a rear perspective view of the header connector 102 in accordance with an exemplary embodiment. FIG. 4 is a front perspective view of the header connector 102 in accordance with an exemplary embodiment. FIG. 5 is a rear view of the header housing 110 without the signal contacts 112 or the ground shield 114 to illustrate various features of the header housing 110. FIGS. 3 and 4 illustrate the signal contacts 112 and the ground shield 114 held by the header housing 110.

In an exemplary embodiment, the header connector 102 includes a pair of the signal contacts 112, such pair defining a differential pair convey differential pair signal through the header connector 102. Other arrangements are possible in alternative embodiments, including a single signal contact 112 or multiple signal contacts 112 convey single ended signals. In other various embodiments, multiple pairs of signal contacts 112 may be provided. In the illustrated embodiment, a single ground shield 114 is provided to shield the pair of signal contacts 112. In other various embodiments, multiple ground shields may be provided.

The header housing 110 is manufactured from a dielectric material, such as a plastic material. In various embodiments, the header housing 110 is injection molded as a single, unitary body. In other various embodiments, the header housing 110 may be formed from multiple pieces. The header housing 110 extends between a mating end 120 and a mounting end 122. The mating end 120 is provided at a front of the header connector 102 for mating with the mating connector 104 (shown in FIG. 1). The mounting end 122 is provided at a rear of the header housing 110 for termination to the circuit board 106 (shown in FIG. 1).

In an exemplary embodiment, the header housing 110 includes a base 124 at the mounting end 122 and a tower 126 extending from the base 124 at the mating end 120. The tower 126 has a cavity 128 that receives a portion of the mating connector 104. The signal contacts 112 and the ground shield 114 extend into the cavity 128 for mating with the mating connector 104. Optionally, the tower 126 may entirely circumferentially surrounds the cavity 128 and the signal contacts 112 and ground shield 114 in the cavity 128. In the illustrated embodiment, the tower 126 is a generally rectangular cross-section with rounded corners defined by end walls 130, 132 and sidewalls 134, 136. The tower 126 may have other shapes in alternative embodiments, such as including greater or fewer walls defining the cavity 128. Optionally, the tower 126 may have a circular cross-section in other various embodiments.

In an exemplary embodiment, the header housing 110 includes a flange 140 extending from at least one of the tower 126 and the base 124. For example, the flange 140 may be located forward of the base 124 and/or rearward of the tower 126, such as at the interface between the base 124 and the tower 126. The flange 140 to be provided at other locations in alternative embodiments, such as remote from the base 124 and or remote from the tower 126. The flange 140 extends radially outward, such as from the tower 126. The flange 140 may extend radially outward from the first end wall 130 and/or the second end wall 132 and/or the first side wall 134 and/or the second side wall 136.

In an exemplary embodiment, the flange 140 includes a lip 142 forming a seal pocket 144. The seal pocket 144 receives the seal 116. The seal pocket 144 is provided at a front 146 of the flange 140. The seal pocket 144 is forward facing to hold the seal 116 at a location for interfacing with the mating connector 104 (shown in FIG. 1) when the mating connector 104 is mated with the header connector 102.

The header housing 110 includes one or more mounting posts 150 at the mounting end 122 for mounting the header housing 110 to the circuit board 106 (shown in FIG. 1). In the illustrated embodiment, the mounting posts 150 extend from a rear 148 of the flange 140; however, the mounting posts 150 may extend from other portions of the header housing 110, such as the base 124. The mounting posts 150 may be used for locating the header housing 110 relative to the circuit board 106. For example, the mounting posts 150 may be received in openings in the circuit board 106 to locate the header housing 110 relative to the circuit board 106. Optionally, the mounting posts 150 extend further rearward than the signal contacts 112 such that the mounting posts 150 are used to provide initial alignment of the header housing 110 and the signal contacts 112 relative to the circuit board 106. For example, the mounting posts 150 may align the signal contacts 112 with corresponding vias in the circuit board 106 for loading the signal contacts 112 into the vias of the circuit board 106. Optionally, the mounting posts 150 may include crush ribs or other features along the exterior surfaces of the mounting posts 150 to engage the circuit board 106. The crush ribs may be used to hold the mounting posts 150 in the circuit board 106 by an interference fit to retain and/or support the header housing 110 on the circuit board 106. Optionally, the mounting posts 150 may include resting blocks 152 that are rearward facing and configured to rest on the top surface of the circuit board 106. The resting blocks 152 locate the mounting posts 150 relative to the circuit board 106, such as by controlling the mounting depth of the mounting posts 150 and to the circuit board 106.

The header housing 110 includes signal contact channels 160 that receive corresponding signal contacts 112 and a ground shield channel 162 that receives the ground shield 114. The signal contact channels 160 position the signal contacts 112 within the header housing 110 and the ground shield channel 162 positions the ground shield 114 within the header housing 110, such as relative to the signal contacts 112. In the illustrated embodiment, the signal contact channels 160 and the ground shield channel 162 pass straight through the header housing 110 to define a vertical header connector 102. For example, the mating end 120 and the mounting end 122 are opposite ends being vertically offset from each other. In other various embodiments, the header connector 102 may be a right angle header connector having the signal contact channels 160 and the ground shield channel 162 that accommodate right angle signal contacts and a right angle ground shield. For example, the mating end 120 and the mounting end 122 may be offset 90° from each other.

In an exemplary embodiment, the signal contact channels 160 extend through the base 124 and are open to the cavity 128. The signal contacts 112 may be rear loaded into the signal contact channels 160 to extend into the cavity 128. Optionally, the signal contacts 112 may be held in the signal contact channels 160 by an interference fit. In various embodiments, the signal contact channels 160 have generally rectangular cross sections; however, the signal contact channels 160 may have other shapes in alternative embodiments. In the illustrated embodiment, the signal contact channels 160 are positioned adjacent each other as a pair of signal contact channels; however, other arrangements are possible in alternative embodiments depending on the particular arrangement of the signal contacts 112 within the header housing 110.

In an exemplary embodiment, the ground shield channel 162 extends through the base 124 and is open to the cavity 128. The ground shield 114 may be rear loaded into the ground shield channel 162 to extend into the cavity 128. Optionally, the ground shield 114 may be held in the ground shield channel 162 by an interference fit. In various embodiments, the ground shield channel 162 is shaped to receive the ground shield 114, such as having a generally U-shaped cross-section; however, the ground shield channel 162 may have other shapes in alternative embodiments. In the illustrated embodiment, the ground shield channel 162 extends around the pair of signal contact channels 160, such as on three sides of the pair of signal contact channels 160; however, other arrangements are possible in alternative embodiments depending on the shape of the ground shield 114.

In an exemplary embodiment, the header housing 110 includes a latching feature on the tower 126 for latchably coupling to the mating connector 104. In the illustrated embodiment, the latching feature 170 includes a ramp 172 at a front of the latching feature 170 and a catch surface 174 at a rear of the latching feature 170. Other types of latching features 170 may be provided in alternative embodiments, such as a deflectable latching feature. In the illustrated embodiment, the latching feature 170 is provided along an exterior 176 of the tower 126, such as along the first end wall 130. The latching feature 170 may additionally or alternatively be provided along the second end wall 132 and/or the first side wall 134 and/or the second side wall 136. Optionally, the latching feature 170 may be provided near the front of the tower 126; however, the latching feature 170 may be provided at other locations in alternative embodiments, such as proximate to the flange 140.

In an exemplary embodiment, the header housing 110 includes one or more guide features 180 to guide mating with the mating connector 104. In the illustrated embodiment, the guide features 180 are defined by ribs 182 extending along the exterior 176 of the tower 126, such as along the first end wall 130. The guide features 180 may additionally or alternatively be provided along the second end wall 132 and/or the first side wall 134 and/or the second side wall 136. Any number of guide features 180 may be provided in various embodiments. Optionally, the guide features 180 may be located asymmetrically along the header housing 110 to define keying features for keyed mating with the mating connector 104. For example, the guide features 180 may restrict improper mating of the mating connector 104 with the header connector 102, such as mating of the mating connector 104 and improper orientation relative to the header connector 102. The guide features 180 may provide keyed mating with various different types of mating connectors 104. For example, the header connector 102 may have different configurations of the guide features 180 defining different types of header connectors 102 for mating with corresponding different types of mating connectors 104 using the keyed guide features 180.

Figure 6:
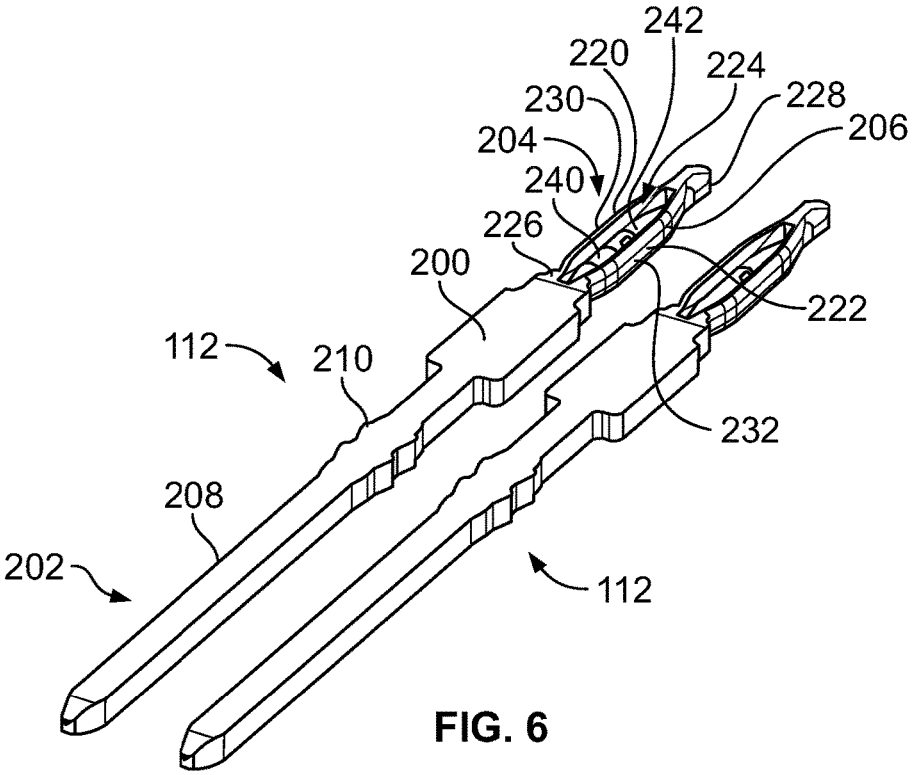
FIG. 6 is a perspective view of a pair of signal contacts of the header connector in accordance with an exemplary embodiment.

FIG. 6 is a perspective view of a pair of the signal contacts 112 in accordance with an exemplary embodiment. Optionally, the signal contacts 112 may be identical. Each signal contact 112 includes a base 200, a mating end 202 extending forward of the base 200 and a mounting end 204 extending rearward of the base 200. The mating end 202 is configured to be mated with the mating connector 104, such as to a corresponding mating contact of the mating connector 104. The mounting end 204 is configured to be terminated to the circuit board 106 (shown in FIG. 1). In the illustrated embodiment, the mounting end 204 includes a compliant pin 206 configured to be press-fit into a plated via of the circuit board 106. In the illustrated embodiment, the signal contacts 112 are straight or vertical contacts; however, the signal contacts 112 may be right angle contacts in alternative embodiments having the mating end 202 and the mounting end 204 oriented perpendicular to each other.

In an exemplary embodiment, the signal contact 112 includes a mating pin 208 at the mating end 202. The mating pin 208 may have a rectangular cross-section, such as a square cross-section having edges at right angles to each other. The mating pin 208 is configured to be received in a socket contact of the mating connector 104. In the illustrated embodiment, the mating pin 208 is chamfered at the distal tip thereof. Optionally, the signal contact 112 may include barbs 210 along side edges of the mating pin 208, such as forward of the base 200. The barbs 210 are used to secure the signal contact 112 in the header housing 110 (shown in FIG. 3). The barbs 210 may dig or pierce into the plastic material of the header housing 110 to hold the signal contact 112 in the header housing 110 by an interference fit. In other various embodiments, the barbs 210 may additionally or alternatively be provided along the base 200.

The compliant pin 206 extends from the base 200. In an exemplary embodiment, the compliant pin 206 includes a first leg 220 and a second leg 222 with an opening 224 between the first leg 220 and the second leg 222. The legs 220, 222 converge at a front 226 and a rear 228 of the compliant pins 206 and are bulged outward between the front 226 and the rear 228. The first leg 220 includes a first mating interface 230 configured to be pressed against the circuit board 106, such as the plated via of the circuit board 106. The second leg 222 includes a second mating interface 232 configured to be pressed against the circuit board 106, such as the plated via of the circuit board 106. The first mating interface 230 is defined along an exterior surface of the first leg 220 and the second mating interface 232 is defined along an exterior surface of the second leg 222. The first and second mating interfaces 230, 232 are on opposite sides of the compliant pins 206 from each other. Optionally, the first and second mating interfaces 230, 232 may be approximately centered between the front 226 and the rear 228.

In an exemplary embodiment, the compliant pin 206 includes one or more spring elements 240 forming a bridge 242 between the first leg 220 and the second leg 222. The spring element 240 imposes a radially outward biasing force on the first leg 220 and/or the second leg 222 forcing the first leg 220 and the second leg 222 outward away from each other. The spring element 240 actively presses the legs 220, 222 apart when mated with the circuit board 106. For example, when the compliant pin 206 is press-fit in a plated via of the circuit board 106, and the legs 220, 222 are flexed inward by the circuit board 106, the spring element 240 counters or reacts against the inward flexing to force the first and second legs 220, 222 apart from each other to maintain pressure of the first and second legs 220, 222 against the circuit board 106. Over time, the interface between the circuit board 106 and the compliant pins 206 may be subject to vibration and the spring element 240 maintains compliance and outward flexing of the compliant pin 206 over time to ensure physical and electrical connection between the compliant pin and the plated via of the circuit board 106.

Figure 7:
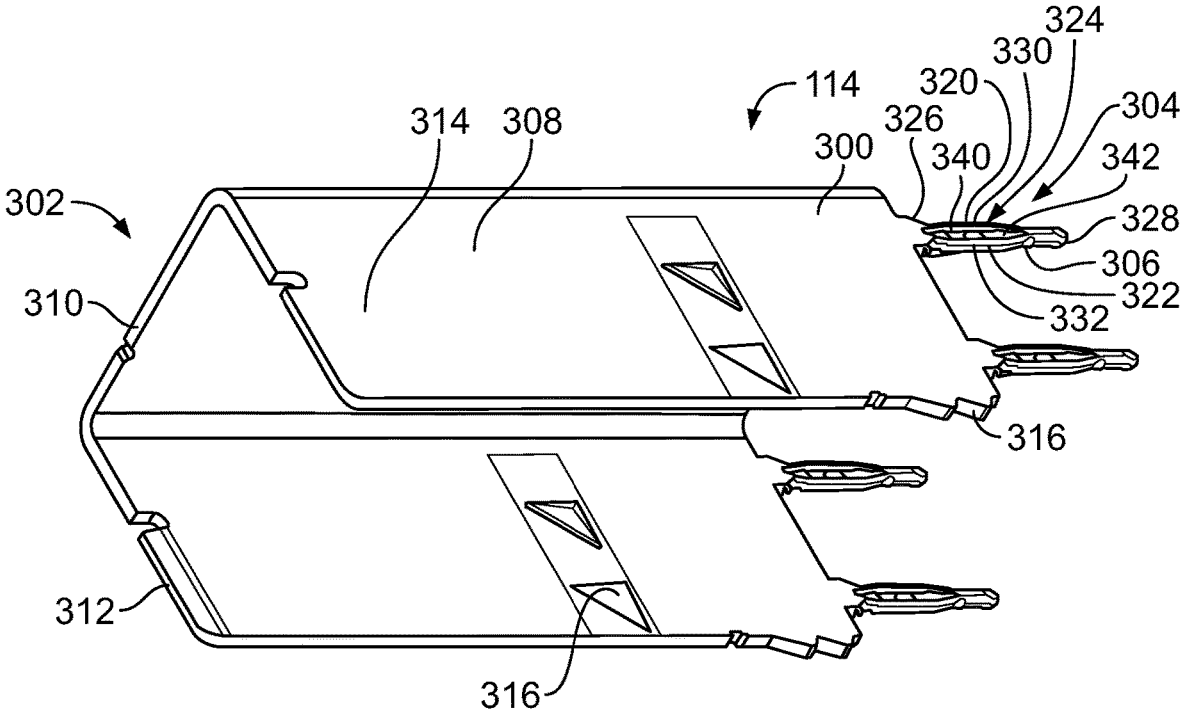
FIG. 7 is a perspective view of a ground shield of the header connector in accordance with an exemplary embodiment.

FIG. 7 is a perspective view of the ground shield 114 in accordance with an exemplary embodiment. The ground shield 114 includes a base 300, a mating end 302 extending forward of the base 300 and a mounting end 304 extending rearward of the base 300. The mating end 302 is configured to be mated with the mating connector 104, such as to one or more ground contacts of the mating connector 104. The mounting end 304 is configured to be terminated to the circuit board 106 (shown in FIG. 1). In the illustrated embodiment, the mounting end 304 includes compliant pins 306 configured to be press-fit into plated vias of the circuit board 106. In the illustrated embodiment, the ground shield 114 is a straight or vertical ground shield; however, the ground shield 114 may be a right angle ground shield in alternative embodiments having the mating end 302 and the mounting end 304 oriented perpendicular to each other.

In an exemplary embodiment, the ground shield 114 includes a shroud 308 at the mating end 302. Optionally, the shroud 308 may be U-shaped, as in the illustrated embodiment, having an end wall 310, a first side wall 312 extending from a first side of the end wall 310 and a second side wall 314 extending from a second side of the end wall 310. Optionally, the ground shield 114 may include barbs 316 along the sidewalls 312, 314 and/or the end wall 310, such as forward of the base 300. The barbs 316 are used to secure the ground shield 114 in the header housing 110 (shown in FIG. 3). The barbs 316 may dig or pierce into the plastic material of the header housing 110 to hold the ground shield 114 in the header housing 110 by an interference fit. The barbs may be stamped from the sidewalls 312, 314 and/or the end wall 310. In other various embodiments, the barbs 316 may additionally or alternatively be provided along the base 300.

The compliant pins 306 extend from the base 300, such as from the sidewalls 312, 314 and/or the end wall 310. Optionally, the compliant pins 306 may be identical to each other. In an exemplary embodiment, the compliant pin 306 includes a first leg 320 and a second leg 322 with an opening 324 between the first leg 320 and the second leg 322. The legs 320, 322 converge at a front 326 and a rear 328 of the compliant pins 306 and are bulged outward between the front 326 and the rear 328. The first leg 320 includes a first mating interface 330 configured to be pressed against the circuit board 106, such as the plated via of the circuit board 106. The second leg 322 includes a second mating interface 332 configured to be pressed against the circuit board 106, such as the plated via of the circuit board 106. The first mating interface 330 is defined along an exterior surface of the first leg 320 and the second mating interface 332 is defined along an exterior surface of the second leg 322. The first and second mating interfaces 330, 332 are on opposite sides of the compliant pins 306 from each other. Optionally, the first and second mating interfaces 330, 332 may be approximately centered between the front 326 and the rear 328.

In an exemplary embodiment, the compliant pin 306 includes one or more spring elements 340 forming a bridge 342 between the first leg 320 and the second leg 322. The spring element 340 imposes a radially outward biasing force on the first leg 320 and/or the second leg 322 forcing the first leg 320 and the second leg 322 outward away from each other. The spring element 340 actively presses the legs 320, 322 apart when mated with the circuit board 106. For example, when the compliant pin 306 is press-fit in a plated via of the circuit board 106, and the legs 320, 322 are flexed inward by the circuit board 106, the spring element 340 counters or reacts against the inward flexing to force the first and second legs 320, 322 apart from each other to maintain pressure of the first and second legs 320, 322 against the circuit board 106. Over time, the interface between the circuit board 106 and the compliant pins 306 may be subject to vibration and the spring element 340 maintains compliance and outward flexing of the compliant pin 306 over time to ensure physical and electrical connection between the compliant pin and the plated via of the circuit board 106.

Returning to FIGS. 3 and 4, when assembled, the signal contacts 112 and the ground shield 114 are loaded in the header housing 110. For example, the bases 200, 300 of the signal contacts 112 and the ground shield 114 are received in the base 124 of the header housing 110. The mounting ends 204, 304 (FIG. 2) extend rearward from the base 124 for mating with the circuit board 106 (shown in FIG. 1). The compliant pins 206, 306 are configured to be press-fit into the plated vias of the circuit board 106. In an exemplary embodiment, the mounting posts 150 extend further than the compliant pins 206, 306 such that the mounting posts 150 may be initially loaded into the circuit board 106 to align the header connector 102 with the circuit board 106. For example, the compliant pins 206, 306 may be aligned with the corresponding plated vias of the circuit board 106.

The ground shield 114 provide electrical shielding for the signal contacts 112. For example, the ground shield 114 extends along three sides of the pair of signal contacts 112. The compliant pins 306 are arranged around the compliant pins 206. The end wall 310 extends along both signal contacts 112. The first side wall 312 extends along one of the signal contacts 112. The second side wall 314 extends along the other signal contact 112. Other shielding arrangements may be provided in alternative embodiments, such as the ground shield 114 providing shielding along the fourth side. In other various embodiments, rather than providing a single ground shield 114, the end wall 310 may be separate from the first and second sidewalls 312, 314 as individual ground shields.

The mating pins 208 (FIG. 4) extend into the cavity 128 for mating with mating contacts of the mating connector 104. The shroud 308 (FIG. 4) extends into the cavity 128 and is exposed in the cavity for mating with the mating connector 104. For example, the end wall 310 and the sidewalls 312, 314 extend along an interior 178 (FIG. 4) of the tower 126.

In an exemplary embodiment, the header connector 102 is a high-speed header connector 102 that is both shielded and sealed. The signal contacts 112 are configured to convey high-speed data signals through the header connector 102. The signal contacts 112 are configured to be terminated to the circuit board 106 using the compliant pins 206, 306 the ground shield 114 provide electrical shielding for the signal contacts 112 to enhance performance of the signal contacts 112. For example, the ground shield 114 reduces noise in the signal contacts 112. The seal 116 (FIG. 4) provides a sealed interface between the header housing 110 and the mating connector 104. As such, the header connector 102 may be used in harsh environments, such as environments subject to moisture or debris, such as automotive applications.

The header connector 102 is configured to be press-fit to the circuit board 106 using the compliant pins 206, 306. The compliant pins 206, 306 provide a high spring force for mating with the plated vias of the circuit board 106. For example, the spring elements 240, 340 provide compliance to the compliant pins 206, 306 to ensure physical electrical connection between the plated vias of the circuit board 106 and the header connector 102. As such, the header connector 102 may be used in harsh environments, such as environments subjected to vibration, such as automotive applications.

Figure 8:
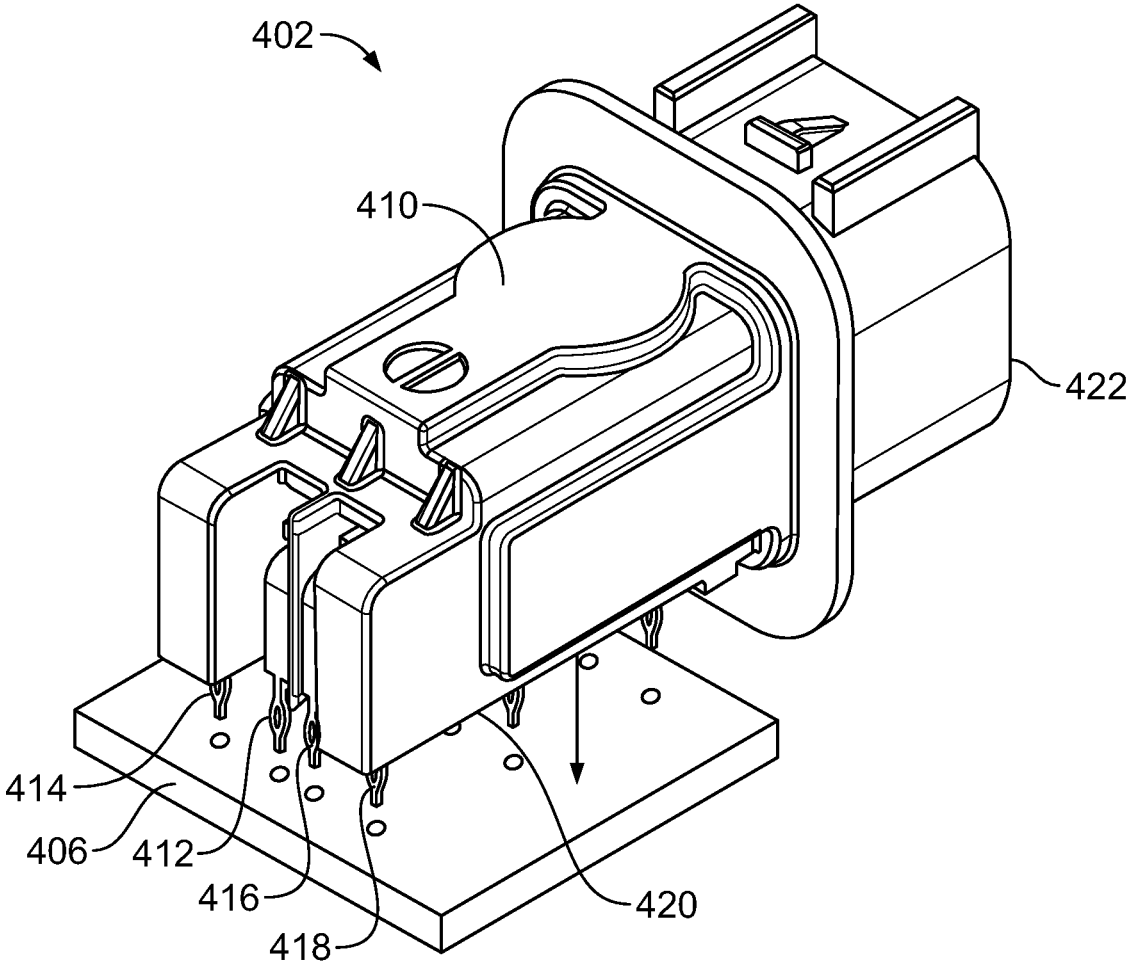
FIG. 8 is a perspective view of a header connector in accordance with an exemplary embodiment.

FIG. 8 is a perspective view of a header connector 402 in accordance with an exemplary embodiment. The header connector 402 is similar to the header connector 102; however, the header connector 402 is a right-angle header connector. The header connector 402 includes a header housing 410 holding signal contacts 412 and a ground shield 414. Compliant pins 416, 418 of the signal contacts 412 and the ground shield 414 extend to a bottom 420 of the header housing 410. Mating ends of the signal contacts 412 and the ground shield 414 extend to a front 422 of the header housing 410 perpendicular to the bottom 420. The signal contacts 412 have a 90° bend to transition between the bottom 420 and the front 422.

In an exemplary embodiment, the header connector 402 is a high-speed, right-angle header connector 402 that is both shielded and sealed. The signal contacts 412 are configured to convey high-speed data signals through the header connector 402. The signal contacts 412 are configured to be terminated to the circuit board 406 using the compliant pins 416, 418. The compliant pins 416, 418 are configured to be press-fit to the circuit board 406 and provide a high spring force for mating with the plated vias of the circuit board 406. As such, the header connector 402 may be used in harsh environments, such as environments subjected to vibration, such as automotive applications. The ground shield 414 provides electrical shielding for the signal contacts 412 to enhance performance of the signal contacts 412, such as to reduce noise in the signal contacts 412. A seal (not shown) may be provided at the mating interface to provide a sealed interface between the header housing 410 and the mating connector. As such, the header connector 402 may be used in harsh environments, such as environments subject to moisture or debris, such as automotive applications.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A header connector comprising:

a header housing having a mating end configured to be mated with a mating connector and a mounting end configured to be mounted to a circuit board, the header housing having a cavity at the mating end, the header housing having a flange forming a seal pocket, the header housing having a base at the mounting end, the base having a signal contact channel open to the cavity and a ground shield channel open to the cavity;

a seal in the seal pocket;

a signal contact received in the signal contact channel and extending through the base into the cavity, the signal contact having a mating end and a mounting end, the mating end configured to be mated with the mating connector, the mounting end having a compliant pin configured to be press-fit into a plated via of the circuit board; and a ground shield received in the ground shield channel and extending through the base into the cavity, the ground shield extending along the mating end of the signal contact and providing electrical shielding for the signal contact.

2. The header connector of claim 1, wherein the header connector includes a shielded connection for the signal contact defined by the ground shield and the header connector includes a sealed connection for the signal contact, the sealed connection defined between the seal and the flange.

3. The header connector of claim 1, wherein the compliant pin of the signal contact includes a spring element imposing a radially outward biasing force.

4. The header connector of claim 1, wherein the compliant pin includes a first leg, a second leg opposite the first leg and a spring element between the first leg and the second leg, the first leg including a first mating interface configured to be pressed against the circuit board, the second leg including a second mating interface configured to be pressed against the circuit board.

5. The header connector of claim 4, wherein the spring element biases the first mating interface of the first leg outward away from the second leg and the spring element biases the second mating interface of the second leg outward away from the first leg.

6. The header connector of claim 1, wherein the header housing includes a seal interface configured to be sealed against a second seal providing sealing between the header housing and the mating connector.

7. The header connector of claim 1, wherein the header housing includes a base at the mounting end having a rear surface facing and configured to engage the circuit board when mounted thereto.

8. The header connector of claim 1, wherein the header housing includes a tower at the mating end surrounding the cavity, the ground shield extending along an interior surface of the tower, the signal contact being spaced apart from the interior surface of the tower.

9. The header connector of claim 8, wherein the flange extends radially outward from the tower, the seal surrounding the tower.

10. The header connector of claim 1, wherein the signal contact channel and the ground shield channel pass straight through the header housing such that the mating end and the mounting end are vertically offset from each other.

11. The header connector of claim 1, wherein the ground shield includes a complaint pin configured to be press-fit into a plated via of the circuit board, the compliant pin of the ground shield includes a first leg, a second leg opposite the first leg and a spring element between the first leg and the second leg, the first leg including a first mating interface configured to be pressed against the circuit board, the second leg including a second mating interface configured to be pressed against the circuit board.

12. A header connector comprising:

a header housing having a mating end configured to be mated with a mating connector and a mounting end configured to be mounted to a circuit board, the header housing having a base at the mounting end and a tower extending from the base to the mating end, the tower having a cavity, the header housing having a flange extending from at least one of the tower and the base, the flange having a lip forming a seal pocket, the header housing having signal contact channels through the base open to the cavity, the header housing having a ground shield channel through the base open to the cavity;

a seal in the seal pocket, the seal being forward facing and including a seal interface engaging the flange of the header housing;

signal contacts received in corresponding signal contact channels and arranged as a pair configured to convey differential signals, each signal contact having a mating end and a mounting end, the mating end configured to be mated with the mating connector, the mounting end having a compliant pin configured to be press-fit into a plated via of the circuit board; and a ground shield received in the ground shield channel, the ground shield having a shroud extending along the mating ends of the signal contacts and providing electrical shielding for the signal contacts, the shroud configured to be mated with the mating connector, the ground shield having a compliant pin configured to be press-fit into a plated via of the circuit board.

13. The header connector of claim 12, wherein the header connector includes a shielded connection for the signal contact defined by the ground shield and the header connector includes a sealed connection for the signal contact defined by the seal.

14. The header connector of claim 12, wherein the compliant pin of the signal contact includes a spring element imposing a radially outward biasing force.

15. The header connector of claim 12, wherein the compliant pin includes a first leg, a second leg opposite the first leg and a spring element between the first leg and the second leg, the first leg including a first mating interface configured to be pressed against the circuit board, the second leg including a second mating interface configured to be pressed against the circuit board.

16. The header connector of claim 15, wherein the spring element biases the first mating interface of the first leg outward away from the second leg and the spring element biases the second mating interface of the second leg outward away from the first leg.

17. The header connector of claim 12, wherein the header housing includes a seal interface configured to be sealed against a second seal providing sealing between the header housing and the mating connector.

18. The header connector of claim 12, wherein the ground shield extends along an interior surface of the tower, the signal contact being spaced apart from the interior surface of the tower.

19. The header connector of claim 12, wherein the seal circumferentially surrounds the tower.

20. The header connector of claim 12, wherein the signal contact channel and the ground shield channel pass straight through the header housing such that the mating end and the mounting end are vertically offset from each other.

21. A header connector comprising:

a header housing having a mating end configured to be mated with a mating connector and a mounting end configured to be mounted to a circuit board, the header housing having a cavity at the mating end, the header housing having a signal contact channel open to the cavity and a ground shield channel open to the cavity, the header housing including a seal interface configured to engage an environmental seal to seal the header housing to the environmental seal;

a signal contact received in the signal contact channel, the signal contact having a mating end extending into the cavity for mating with the mating connector, the signal contact having a mounting end extending from the header housing for termination to the circuit board, the mounting end having a compliant pin configured to be press-fit into a plated via of the circuit board, the compliant pin having a spring element configured to press the compliant pin outward against the plated via of the circuit board; and a ground shield received in the ground shield channel, the ground shield extending into the cavity along the mating end of the signal contact and providing electrical shielding for the signal contact, the ground shield extending from the header housing for termination to the circuit board.

22. The header connector of claim 21, wherein the spring element imposes a radially outward biasing force.

23. The header connector of claim 21, wherein the compliant pin includes a first leg, a second leg opposite the first leg and a spring element between the first leg and the second leg, the first leg including a first mating interface configured to be pressed against the circuit board, the second leg including a second mating interface configured to be pressed against the circuit board.

24. The header connector of claim 23, wherein the spring element biases the first mating interface of the first leg outward away from the second leg and the spring element biases the second mating interface of the second leg outward away from the first leg.

25. A signal contact for an electrical connector comprising:

a base;

a mating end extending forward of the base, the mating end configured to be mated with a mating connector; and a mounting end extending rearward of the base configured to be terminated to a circuit board, the mounting end having a compliant pin configured to be press-fit into a plated via of the circuit board, the compliant pin having a spring element imposing a radially outward biasing force configured to press the compliant pin outward against the plated via of the circuit board.

26. The signal contact of claim 25, wherein the compliant pin includes a first leg and a second leg opposite the first leg, the first leg including a first mating interface configured to be pressed against the circuit board, the second leg including a second mating interface configured to be pressed against the circuit board, the spring element extending between the first leg and the second leg.

27. The signal contact of claim 26, wherein the spring element biases the first mating interface of the first leg outward away from the second leg and the spring element biases the second mating interface of the second leg outward away from the first leg.

* * * * *